US010562743B2

(12) United States Patent
Fretz

(10) Patent No.: US 10,562,743 B2
(45) Date of Patent: Feb. 18, 2020

(54) COMPOSITE FAIRLEAD WITH A WEAR PLATE

(71) Applicant: Warn Industries, Inc., Clackamas, OR (US)

(72) Inventor: Darren G. Fretz, Oregon City, OR (US)

(73) Assignee: WARN INDUSTRIES, INC., Clackamas, OR (US)

( * ) Notice: Subject to any disclaimer, the term of this patent is extended or adjusted under 35 U.S.C. 154(b) by 168 days.

(21) Appl. No.: 15/586,746

(22) Filed: May 4, 2017

(65) Prior Publication Data

US 2017/0320710 A1 Nov. 9, 2017

Related U.S. Application Data

(60) Provisional application No. 62/331,562, filed on May 4, 2016.

(51) Int. Cl.
*B66D 1/36* (2006.01)
*B63B 21/10* (2006.01)

(52) U.S. Cl.
CPC ..... *B66D 1/36* (2013.01); *B63B 21/10* (2013.01)

(58) Field of Classification Search
CPC ..... B63B 21/10; B66D 1/36
See application file for complete search history.

(56) References Cited

U.S. PATENT DOCUMENTS

| | | | | |
|---|---|---|---|---|
| 2,418,105 | A * | 3/1947 | Wohler | F16L 5/00 16/2.1 |
| 4,317,549 | A * | 3/1982 | Thomas | B65H 57/06 226/196.1 |
| 4,736,929 | A * | 4/1988 | McMorris | B66D 1/22 254/323 |
| 5,671,878 | A * | 9/1997 | Kawasaki | B21B 39/14 140/147 |
| 6,471,191 | B1 * | 10/2002 | Rotzler | B66D 1/36 226/196.1 |
| 6,865,875 | B2 * | 3/2005 | Watkins | D07B 3/10 57/115 |
| D731,293 | S * | 6/2015 | Fretz | D8/356 |
| 9,499,236 | B1 * | 11/2016 | Arlet | B63B 21/06 |
| 9,604,826 | B2 * | 3/2017 | Fretz | B66D 1/02 |
| D807,733 | S * | 1/2018 | Fretz | D8/356 |
| 10,093,523 | B2 * | 10/2018 | Averill | B66D 1/00 |
| 2006/0174811 | A1 * | 8/2006 | Jungblom | B63B 21/18 114/210 |
| 2010/0050396 | A1 * | 3/2010 | Gates | B63B 21/10 24/115 R |
| 2012/0037060 | A1 * | 2/2012 | Chapman | B63B 21/04 114/218 |
| 2012/0187355 | A1 * | 7/2012 | Mehrkens | A63C 11/10 254/222 |

(Continued)

FOREIGN PATENT DOCUMENTS

GB 191225393 A * 8/1913 ..... B63B 21/14

*Primary Examiner* — Michael E Gallion
(74) *Attorney, Agent, or Firm* — K&L Gates LLP

(57) ABSTRACT

Systems are provided for a fairlead, and in particular to a hawse fairlead. In one example, the fairlead may include a wear insert positioned within a first opening of a fairlead frame configured to guide a rope and/or cable. The wear insert may be constructed from a denser material than the frame.

20 Claims, 5 Drawing Sheets

(56) References Cited

U.S. PATENT DOCUMENTS

| | | | | |
|---|---|---|---|---|
| 2014/0291030 | A1* | 10/2014 | Urquhart | E21B 19/24 175/203 |
| 2016/0068376 | A1* | 3/2016 | Fretz | B66D 3/00 254/219 |
| 2017/0066507 | A1* | 3/2017 | Arlet | B63B 21/06 |
| 2017/0321851 | A1* | 11/2017 | Fretz | B63B 21/14 |
| 2018/0009627 | A1* | 1/2018 | Mabbett | B63B 21/04 |
| 2018/0111664 | A1* | 4/2018 | Strube | B63B 21/04 |
| 2018/0118529 | A1* | 5/2018 | Vaughn | B66D 1/12 |

* cited by examiner

COMPOSITE FAIRLEAD WITH A WEAR PLATE

CROSS REFERENCE TO RELATED APPLICATIONS

The present application claims priority to U.S. Provisional Patent Application No. 62/331,562, entitled "A Composite Fairlead with a Wear Plate," filed on May 4, 2016, the entire contents of which are hereby incorporated by reference for all purposes.

FIELD

The present application relates generally to systems for guiding retractable ropes, lines, and cables.

SUMMARY/BACKGROUND

A fairlead, such as a hawse fairlead, may be used to guide and restrict lateral movement of a rope and/or cable, as the rope and/or cable is pulled through the fairlead. Specifically, the rope and/or cable may extend through an opening in the fairlead and lateral movement of the rope and/or cable may be constrained to within the opening. Fairleads may be used in winches, hoists, boats, and other applications where a rope and/or cable is subjected to bi-directional motion. In particular, fairleads may be mounted to a device to guide a rope and/or cable of the device. For example, fairleads may be mounted to a vehicle, in front of a winch, to guide the rope and/or cable of the winch.

When the rope and/or cable is pulled through the fairlead, it may contact the surfaces of the opening. The surfaces of the fairlead opening may therefore be prone to abrading and degradation due to prolonged contact with the rope and/or cable. As such, some approaches aimed at reducing degradation of the fairlead may include constructing the fairlead from a durable material such as a metal (e.g., aluminum) or metal composite.

However, the inventors herein have recognized several problems with such fairleads. As one example, constructing the fairlead from metal and/or metal composite may increase the weight of the fairlead. Heavier fairleads may exert more of a load and strain on the device to which they are mounted (e.g., front a vehicle). As such, fairleads constructed from metal or metal composite may lead to premature degradation of the device to which they are mounted.

In one example, the above issues may be at least partially addressed by a fairlead comprising a frame including a central opening and comprising a first material, and a wear insert positioned within the central opening and comprising a second material, different than the first material. Specifically, in some examples the first material may be less dense than the second material. For example, the first material may comprise a composite polymer and the second material may comprise a metal or metal composite.

In this way, by constructing the fairlead frame from a lighter composite polymer, while fitting the opening of the fairlead with a metal wear insert, the durability of the fairlead may be maintained relative to fairleads constructed entirely from metal, while the weight of the fairlead may be reduced. Specifically, by including the metal wear insert at the fairlead/rope interface, abrading and degradation of the fairlead caused by the rope may be reduced, while the weight of the fairlead may be reduced by constructing the frame from a composite polymer. By reducing the weight of the fairlead, strain and load on a device to which the fairlead is coupled may be reduced.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

Figure 1:
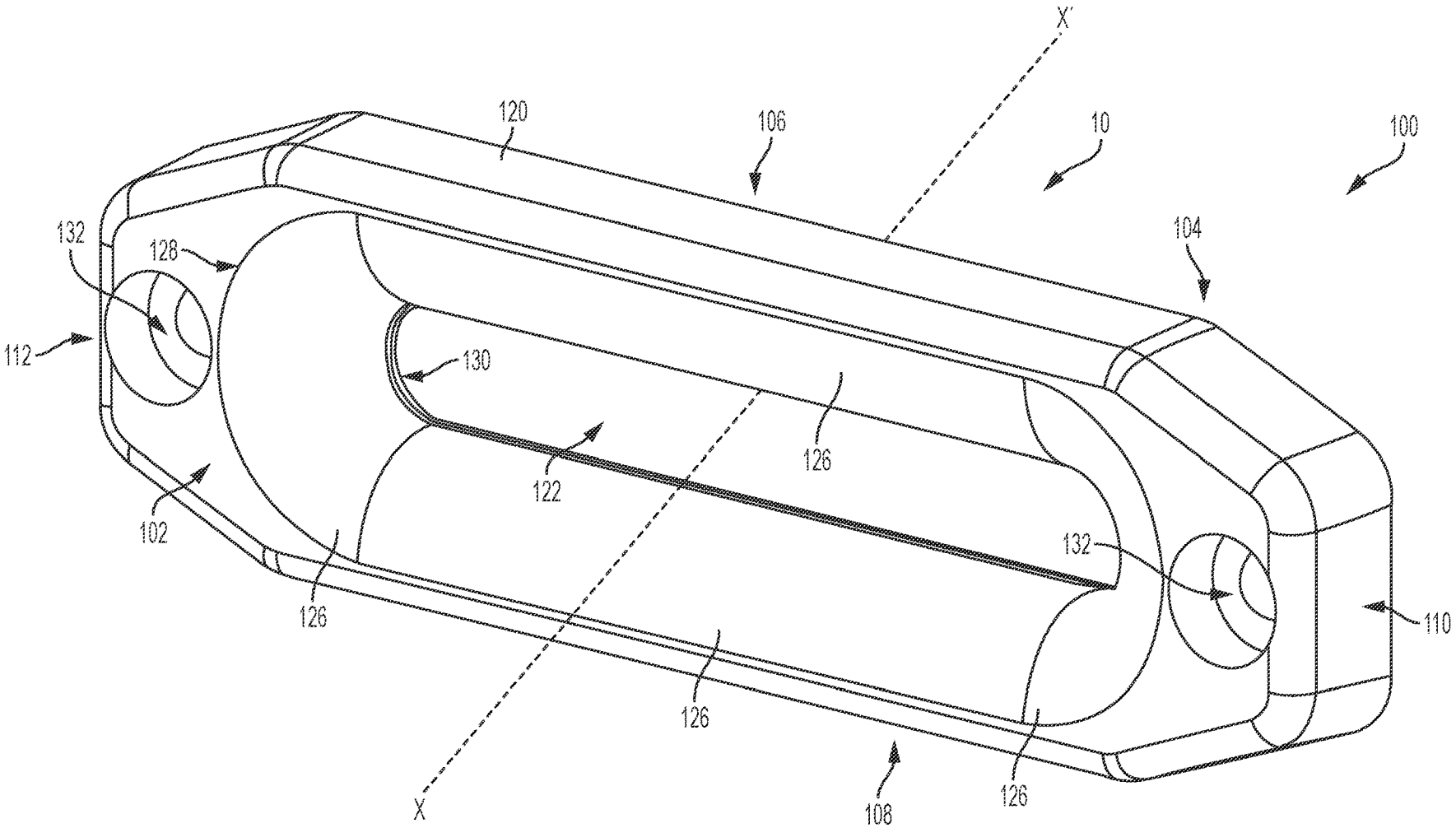
FIG. 1 shows a front exterior view of a fairlead, in accordance with one or more embodiments of the present disclosure.

The figures are drawn to scale, although other relative dimensions may be used, if desired.

DETAILED DESCRIPTION

The following detailed description relates to fairleads, and in particular to hawse fairleads. A fairlead, such as any of the example fairleads shown in FIGS. 1-4, may guide and restrict lateral movement of a rope and/or cable, as the rope and/or cable is pulled through the fairlead. Specifically, the rope and/or cable may extend through an opening in the fairlead and lateral movement of the rope and/or cable may be constrained to within the opening. The fairlead may be attached to a winch to guide the rope and/or cable of the winch, such as is shown in the example of FIG. 5. As the rope and/or cable is pulled through the fairlead, it may contact the surfaces of the opening. The surfaces of the fairlead opening may therefore be prone to abrading due to prolonged contact with the rope and/or cable. However, in some examples, as shown in FIGS. 1-4, abrading of the fairlead opening may be reduced by fitting the opening that directly contacts the rope and/or cable with a metal wear insert. Further, the weight of the fairlead may be reduced by constructing the frame of the fairlead from a composite polymer.

FIGS. 1-5 show the relative positioning of various components of a fairlead. If shown directly contacting each other, or directly coupled, then such components may be referred to as directly contacting or directly coupled, respectively, at least in one example. Similarly, components shown contiguous or adjacent to one another may be contiguous or adjacent to each other, respectively, at least in one example. As an example, components lying in face-sharing contact with each other may be referred to as in face-sharing contact or physically contacting one another. As another example, elements positioned apart from each other with only a space there-between and no other components may be referred to as such, in at least one example.

As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

FIG. 1 shows a front perspective view 100 of a first embodiment of a fairlead 10. The fairlead 10 comprises a fairlead frame or housing 120. The frame 120 may include a front-facing surface 102 opposite a rear-facing surface 104, a top-facing surface 106 opposite a bottom-facing surface 108, and a first side surface 110 opposite a second side surface 112. As shown in the example of FIG. 1, the side surfaces 110 and 112 may be the same and/or similar size and shape. Further, the side surfaces 110 and 112, may each include three substantially planar edges, where one of the edges of each of the side surfaces 110 and 112 is approximately orthogonal to the top-facing surface 106 and bottom-facing surface 108. However, in other examples, each of the side surfaces 110 and 112 may include more or less than three edges. For example, the side surfaces 110 and 112 may include a single planar edge that connects the top-facing and bottom-facing surfaces 106 and 108.

In some examples, one or more of the top-facing surface 106 may be parallel the bottom-facing surface, the front-facing surface 102 may be parallel the rear-facing surface 104, and at least one of the edges of the first side surface 110 may be parallel to at least one of the edges of the second side surface 112. A central axis X-X' of the frame 120 is shown in FIG. 1, where the central axis X-X' may be centrally positioned with respect to the frame 120 and may extend through the frame 120 from the front-facing surface 102 to the rear-facing surface 104. Thus, the central axis X-X' may be perpendicular to the front-facing surface 102 and/or rear-facing surface 104. Further, the axis X-X' may pass through a center of the frame 120.

In the description herein, a "thickness" of the fairlead frame 120 may be used to define the physical extent of the frame 120 along the axis X-X.' Thus, the thickness of the frame 120 may refer to the distance between the front-facing surface 102 and the rear-facing surface 104. Further, a "width" of the frame 120 may be used to refer to the distance between the side surfaces 110 and 112, and a "height" of the frame 120 may be used to refer to the distance between the top-facing surface 106 and the bottom-facing surface 108.

The frame 120 includes a first opening or aperture 122 through which a rope and/or cable (not shown in FIG. 1) may extend. Thus, the opening 122 and frame 120 may restrict lateral movement of a rope and/or cable as the rope and/or cable is pulled through the fairlead 10. The opening 122 may extend through an entirety of the frame 120, from the front-facing surface 102 to the rear-facing surface 104, such that the rope and/or cable may extend through the fairlead 10.

In some examples, the opening 122 may be centrally positioned within the frame 120. As such, the opening 122 may also be referred to herein as central opening 122. Thus, the opening 122 may be centered on the central axis X-X.' The opening 122 may therefore be equidistant from the top-facing surface 106 and the bottom-facing surface 108, and/or may be equidistant from the first side surface 110 and second side surface 112. However, it should be appreciated that in other examples the opening 122 may not be centrally positioned within the frame 120. For example, as described below with reference to FIGS. 5-11, the opening 122 may be positioned more proximate the bottom-facing surface 108 than the top-facing surface 106.

The first opening 122 may be defined at the front-facing surface 102 by a first edge 128 and at the rear-facing surface 104 by a second edge 130. Said another way, the front-facing surface 102 may include the first edge 128, where the first edge 128 defines the cross-sectional area of the opening 122 at the front-facing surface 102. Similarly, the rear-facing surface 104 may include the second edge 130, which defines the cross-sectional area of the opening 122 at the rear-facing surface 104. The first edge 128 may also be referred to herein as first perimeter 128, and second edge 130 may be also be referred to herein as second perimeter 130, as the edges 128 and 130 may define the perimeter of cross-sections of the opening 122 at the front-facing surface 102 and rear-facing surface 130, respectively.

In some examples, such as the example shown in FIG. 1, cross-sections of the opening 122, taken along a plane parallel to the plane defined by the rear-facing surface 104 and/or front-facing surface 102, at the front-facing surface 102 and rear-facing surface 104 may define the same or similar shape. Further, in some examples, cross-sections of the opening 122 may define the same or similar shape along the axis X-X' between the front-facing surface and the rear-facing surface 104. Thus, substantially all of the cross-sections of the opening 122 may be concentric. As such, the opening 122 may be symmetric with respect to the central axis X-X.'

Thus, the edges 128 and 130 may define the perimeter of the same or similar shape. However, in other examples, the edges 128 and 130 may define the perimeter of different shapes and the cross-sections of the opening 122 at the front-facing surface 102 and rear-facing surface 104 may define different shapes. In the example shown in FIG. 1, the edges 128 and 130 may define an obround shape, comprising two parallel lines of equal length, connected by semicircular ends. However, the edges 128 and 130 may be shaped differently to define the perimeters of other geometric and non-geometric shapes such as rectangles, rectangles with rounded corners, ovals, ellipses, circles, etc. Thus, the edges 128 and 130 may define an oblong shape with two straight parallel sides connected by curved ends. In some examples, the curved ends of the central opening 122 may have a first diameter at the front-facing surface 102 and a second diameter at the rear-facing surface 104, where the first diameter may be larger than the second diameter. However, in other examples, it should be appreciated that the diameters of the curved ends may be the same and/or similar at the front and rear-facing surfaces 102 and 104. In yet further examples, the curved ends of the opening 122 may be larger at the rear-facing surface 104 than the front-facing surface 102.

A first perimeter of the first edge 128 may be greater than a second perimeter of the second edge 130, and thus, the cross-sectional area of the opening 122 may be greater at the front-facing surface 102 than at the rear-facing surface 104. In this way, the cross-sectional area of the opening 122 may vary from the front-facing surface 102 to the rear-facing surface. In particular, the cross-sectional area of the opening 122 may monotonically decrease from the front-facing surface 102 to the rear-facing surface 104, such as is shown in the example of FIG. 1. As such, the first opening 122 includes a continuous curved surface 126 that curves outward from the second edge 130 to the first edge 128. Thus, the continuous curved surface 126 may be convex.

However, in other examples, the first perimeter of the first edge 128 may be the same and/or similar to the second perimeter of the second edge 130, and therefore the cross-sectional area of the opening 122 may be approximately the same at the front and rear-facing surfaces 102 and 104. In such examples, the cross-sectional area of the opening 122 may be relatively constant along the thickness or axis X-X' of the frame 120 (e.g., when moving from the front-facing surface 102 to the rear-facing surface 104). However, in still further examples, the first perimeter of the first edge 128 may be smaller than the second perimeter of the second edge 130, and therefore the cross-sectional area of the opening 122 may be larger at the rear-facing surface 104 than the front-facing surface 102.

In some examples, such as the example shown in FIG. 1, the edge 128 may be flush with the front-facing surface 102. Thus, the edge 128 may be continuous with the front-facing surface 102, and may define an edge of the front-facing surface 102. However, in other examples, the edge 128, may be raised from the front-facing surface 102, such as for example as a raised lip. Thus, in some examples, the edge 128 may be referred to herein as lip 128. In such examples, where the edge 128 is formed as a lip, the central opening 122 may be formed by the lip (e.g., edge 128) in the frame 120 that extends outward from the front-facing surface 102 the frame 120. Thus, in such examples, the continuous curved surface 126 of the central opening 122 may be defined between an inner edge of the lip 128 and the rear-facing surface 104. In yet further examples, the edge 128 may be recessed from the front-facing surface 102 and may form a slot or groove. Thus, in some examples, the edge 128 may be referred to herein as slot 128. In such examples, where the edge 128 is formed as a recessed slot, the central opening 122 may be formed by the recess (e.g., edge 128) in the frame 120 that extends inward from the front-facing surface 102 the frame 120. Thus, in such examples, the continuous curved surface 126 of the central opening 122 may be defined between an inner edge of the recess 128 and the rear-facing surface 104.

Similarly, the edge 130 may be flush with the rear-facing surface 104, such as in the example shown in FIG. 1. Thus, the edge 130 may be continuous with the rear-facing surface 104, and may define an edge of the rear-facing surface 104. However, in other examples, the edge 130, may be raised from the rear-facing surface 104, such as for example as a raised lip. In yet further examples, the edge 130 may be recessed from the rear-facing surface 104.

The fairlead frame 120 may further include one or more bores 132 including a central portion that may extend through an entirety of the frame 120 in the direction of the axis X-X' and an outer portion surrounding the central portion that extends to the front-facing surface of the bore 132 which may be arranged at the front-facing surface 102. Specifically, the central portion may define smaller cross-sectional area than the outer portion, and the outer portion may extend from the front-facing surface 102 of the frame 120 into the frame 120, up to the central portion. The central portion, may then extend from the outer portion to the rear-facing surface 104 of the frame 120. The transition between the central portion and outer portion may be defined by a step. Thus, the bores 132 may extend from the front-facing surface 102 to the rear-facing surface 104. In the description herein, the bores 132 may also be referred to as mounting apertures 132. As shown in the example of FIG. 1, the frame 120 may include two mounting apertures 132, disposed on opposite sides of the opening 122. However, in other examples, the frame 120 may include more or fewer than two bores 132. The bores 132 may be sized to receive fasteners such as bolts, screws, etc., for physically securing the fairlead 10 to a desired structure.

Thus, one or more bolts may extend through the bores 132 and fairlead frame 120 and into the desired structure to which the fairlead 10 is to be attached, to physically couple the fairlead 10 to the structure. In one example, an elongated end of the bolt or screw (which may be threaded) may extend through the bore 132 and past the rear-facing surface 104 and an inner side of a head of the bolt or screw may be in face-sharing contact with a front-facing surface of the central portion, and thus the head of the bolt or screw may be arranged within the outer portion of the bore 132. In this way, the head of the bolt or screw may fit within the outer portion of the bore 132, and the elongated end of the bolt or screw may extend through the central portion of the bore 132, and out of the back of the frame 120 through the rear-facing surface 104. In some examples, a front-facing surface of the head of the bolt or screw may be flush with the front-facing surface 102 of the frame 120. However, in other examples, the front-facing surface of the head of the bolt or screw may be recessed or raised relative to the front-facing surface 102 of the frame 120. As shown below with reference to the example in FIG. 5, the fairlead 10 may be coupled to a winch or to a vehicle in front of the winch, to guide the winch rope and/or cable during winching operation. As another example, the fairlead 10 may be coupled to a hoist to guide the rope and/or cable of the hoist. As yet another example, the fairlead 10 may be coupled to a ship and/or boat for guiding one or more of mooring lines, anchoring cables, etc.

The fairlead frame 120 may be constructed from a first material which may comprise polymers, composite polymers, plastics, etc. The first material may comprise a first density, where the first density may be in a range of densities between 1.05 g/cm$^3$ and 3.0 g/cm$^3$. As described below with reference to FIG. 2, a wear insert, constructed from a different material than the fairlead frame 120, may be coupled to the curved surface 126 of the fairlead frame 120.

Figure 2:
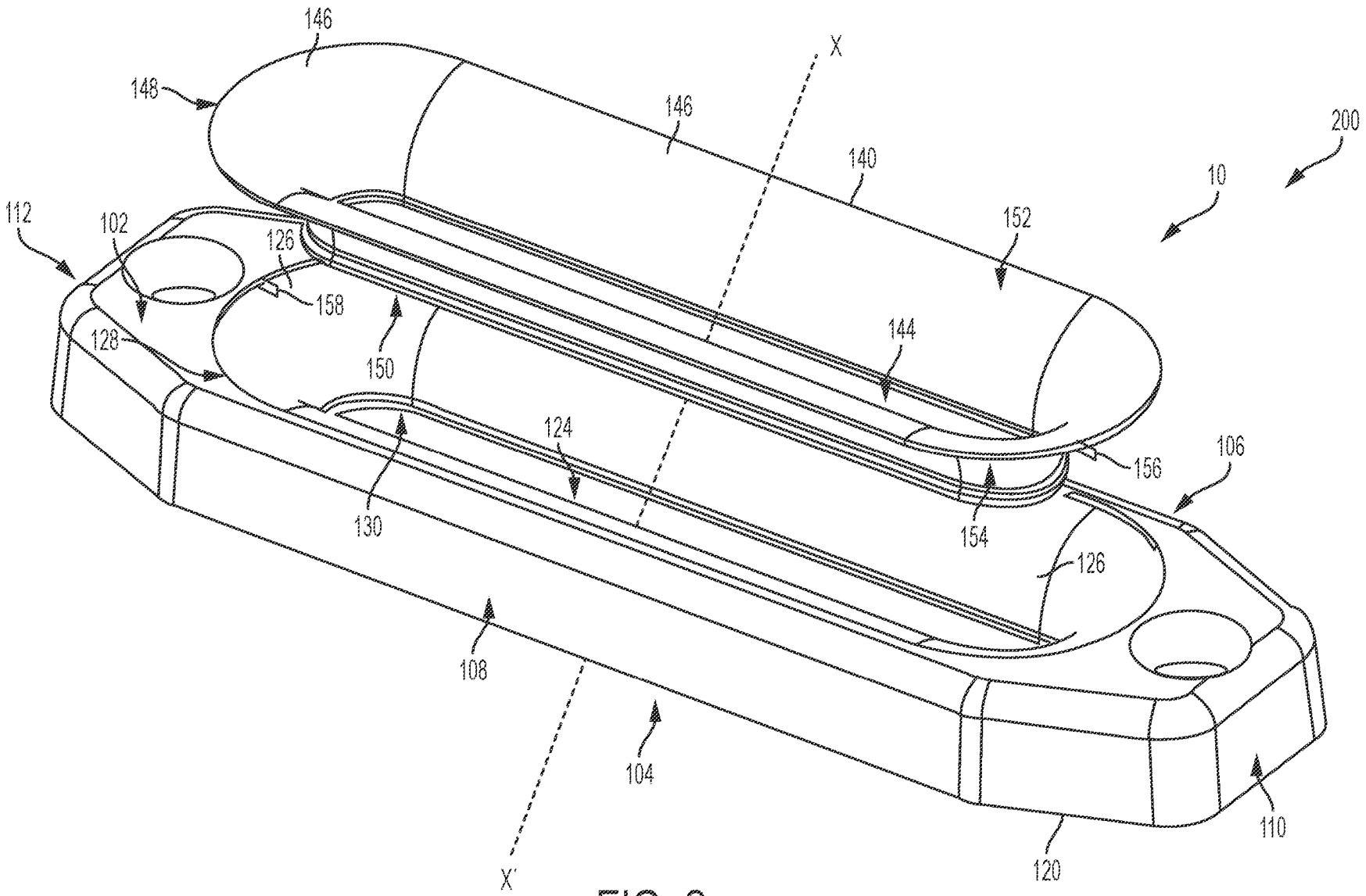
FIG. 2 shows an exploded perspective view of the fairlead of FIG. 1, including a wear insert, in accordance with one or more embodiments of the present disclosure.
Figure 3:
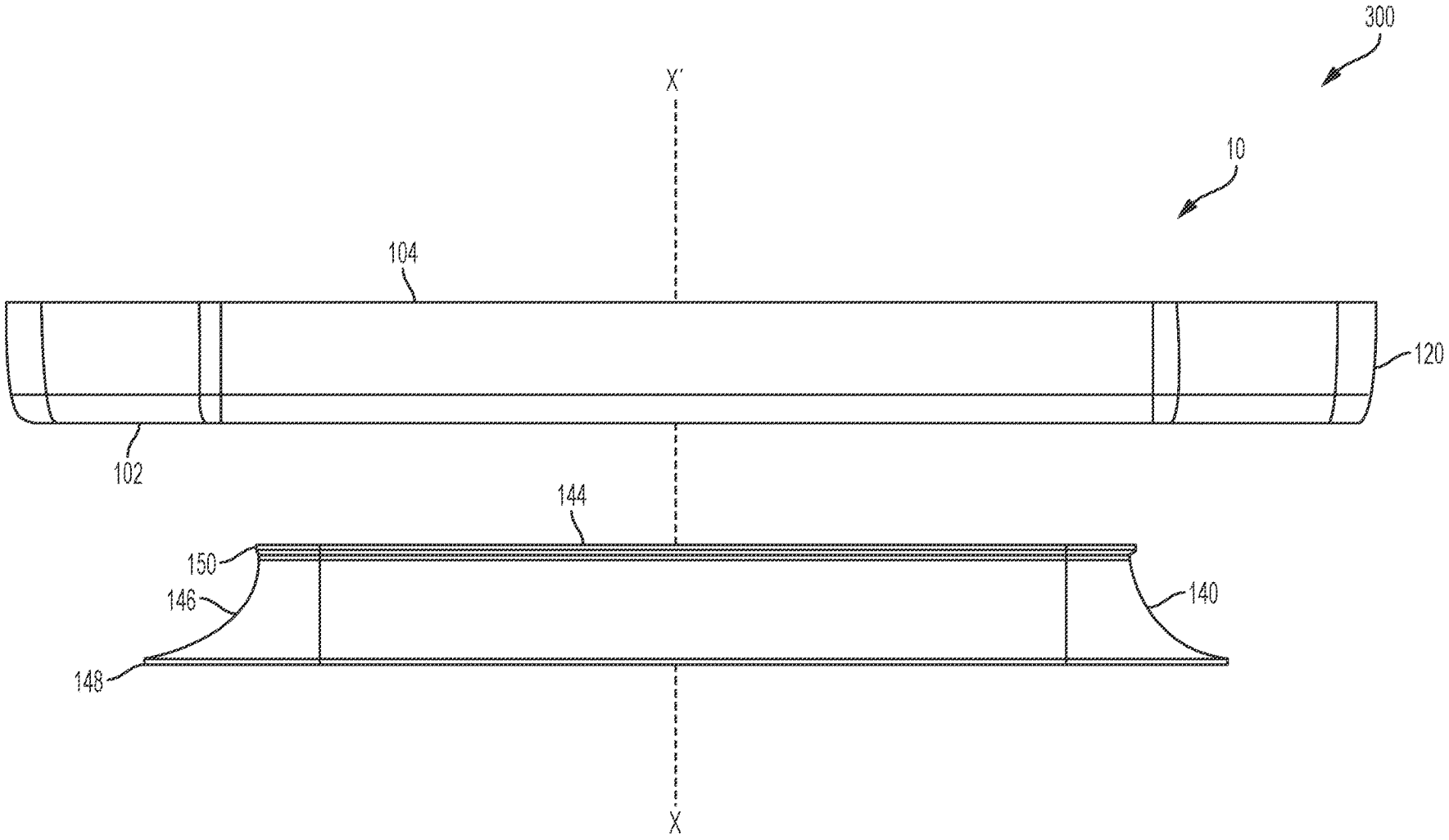
FIG. 3 shows an exploded top view of the fairlead of FIG. 1, including the wear insert shown in FIG. 2, in accordance with one or more embodiments of the present disclosure.
Figure 4:
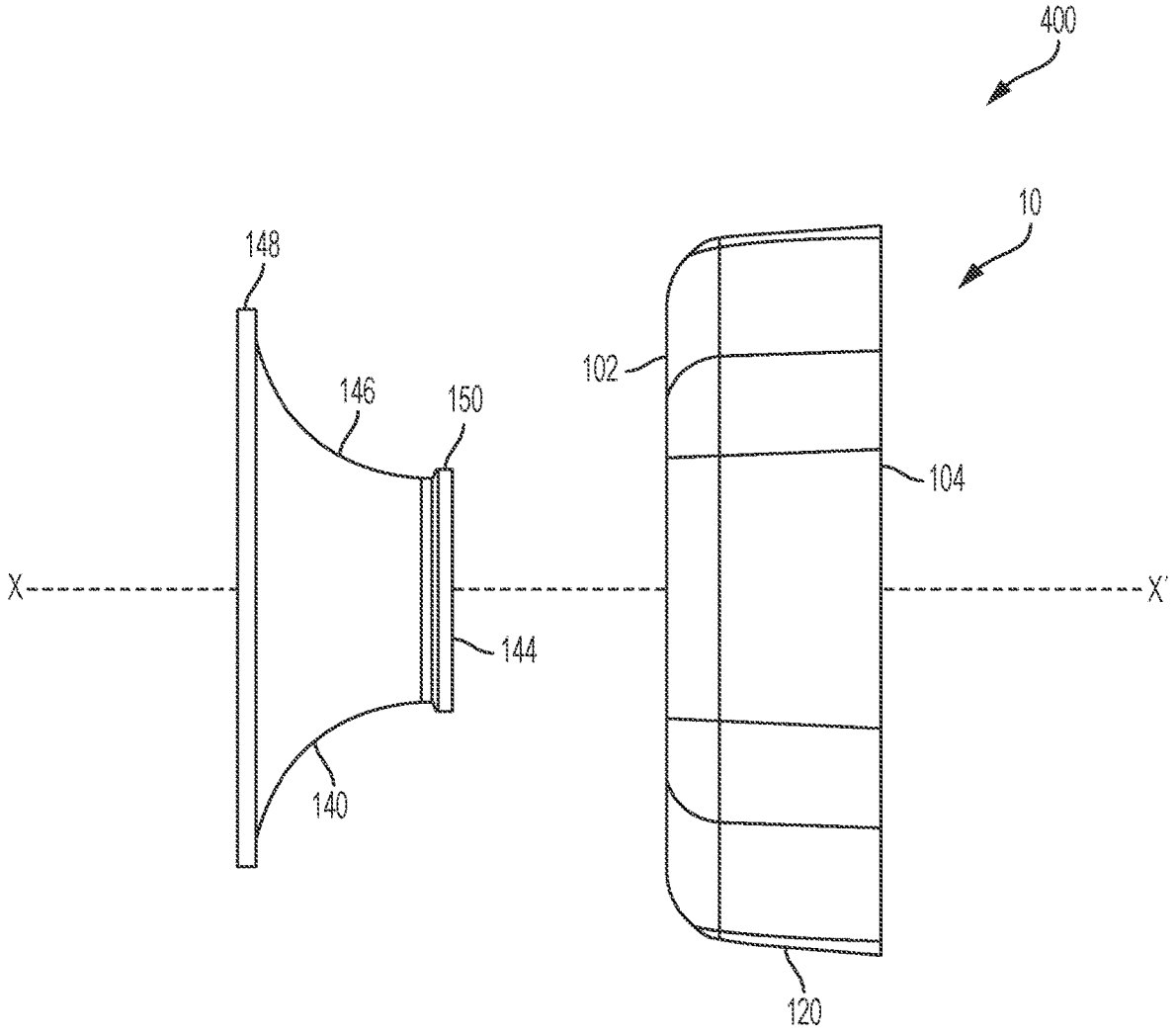
FIG. 4 shows an exploded side view of the fairlead of FIG. 1, including the wear insert shown in FIG. 2, in accordance with one or more embodiments of the present disclosure.
Figure 5:
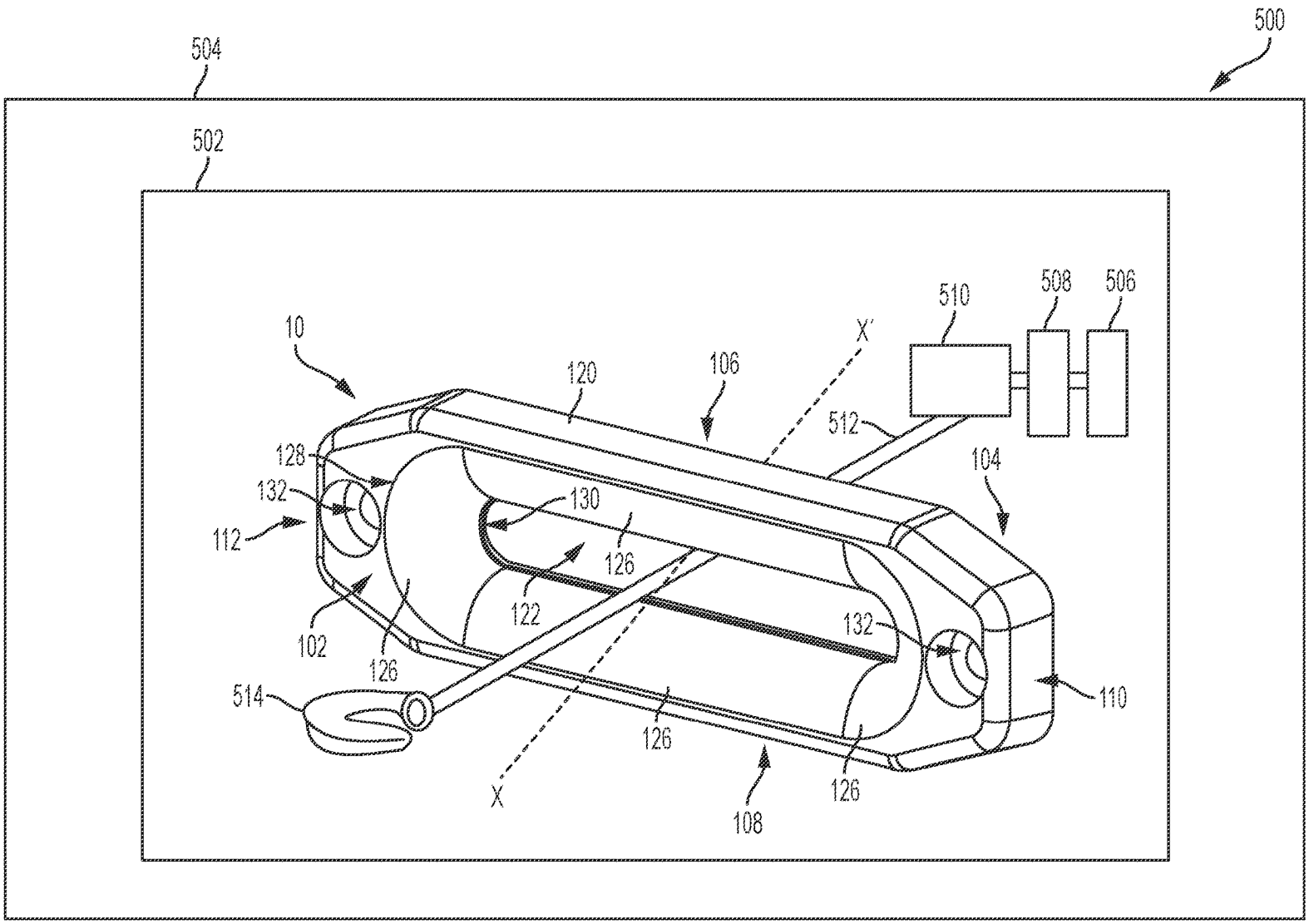
FIG. 5 shows a front exterior view of the fairlead of FIG. 1 coupled to a winch and vehicle, in accordance with one or more embodiments of the present disclosure.

Turning now to FIGS. 2-4, they show exploded views of the fairlead 10 of FIG. 1, including the fairlead frame 120 previously discussed above in FIG. 1, and a wear insert 140. Wear insert 140 may also be referred to herein as wear plate 140. As such, FIGS. 2-4 will be described together in the description herein. Specifically, FIG. 2 shows an exploded perspective view 200, FIG. 3 shows an exploded top view 300, and FIG. 4 shows an exploded side view 400, of the fairlead 10 including the frame 120 and wear insert 140.

The wear insert 140 may be coupled to the curved surface 126 of the fairlead frame 120, and may directly contact a rope and/or cable that is pulled through the fairlead 10. Thus, the wear insert 140 may completely cover surfaces of the fairlead frame 120 facing and/or contacting the rope and/or cable. As such, the fairlead frame 120 may not contact the rope and/or cable when the insert 140 is coupled to the frame 120, as the insert 140 may be positioned between the frame 120 and the rope and/or cable. Said another way, the insert 140 may completely cover the surfaces of the opening 122. However, in other examples, the insert 140 may cover only a portion of the surfaces (e.g., curved surface 126 described above in FIG. 1) of the opening 122.

The wear insert 140 may be constructed from a second material, the second material different than the first material of the frame 120. Specifically, as described above with reference to FIG. 1, the frame 120 may be constructed from a first material which may be a composite material or polymer. The wear insert 140 may be constructed from the second material which may comprise one or more of a metal, metal alloy, or metal composite such as aluminum. In one example, the wear insert may be constructed from aluminum. However, in other examples, the wear insert 140 may be constructed from one or more of steel, iron, etc. Further, the wear insert 140 may be constructed from a single metal element or alloy. However, in other examples, the wear insert 140 may be a composite, constructed from a combination of more than one metal element or alloy. The second material of the wear insert 140 may comprise a second density, the second density different than the first density of the frame 120. Specifically, the second density of the second material of the wear insert 140 may be greater than the first density of the first material of the frame 120. In particular, the second density of the second material may be a density in a range of densities between 2.63 g/cm$^3$ and 8.2 g/cm$^3$.

The second material may thus be denser and more durable than the first material of the frame. Further, the second material may have a higher strength than the first material. Thus, the weight of the fairlead may be reduced by including the less dense frame around the more durable wear insert. However, it should be appreciated that in other examples, the first material may be denser than second material, and that the first material may have a higher strength than the second material. Additionally, the second material may be harder (e.g., denser) than the winch rope, thereby reducing wear of the winch rope.

The second material of the wear insert 140 may have a lower coefficient of friction than the first material of the frame 120. Thus, the wear insert 140 may have a lower resistance to sliding (e.g., bidirectional) motion of, for example, a rope and/or cable. In this way, frictional losses incurred at the interface of the rope and fairlead 10 may be reduced by including the wear insert 140. In this way, the wear insert 140 may form a contact surface, where the contact surface is the surface of the fairlead 10 that interfaces with and directly contacts the rope and/or cable. The wear insert 140 may be stamped or formed from metal and insert molded into the frame 120. However, in other examples, the wear insert 140 may be physically coupled to the frame 120 via one or more of adhesives, fasteners, etc. In yet further examples, the wear insert 140 may be snap-fit into the frame 120, where the edges of the wear insert 140 may be compressed while pushing the wear insert 140 into the frame 120, and then may snap outwards when the insert 140 is aligned with the continuous curved surface 126 of the frame 120 to couple and hold the wear insert 140 in place relative to the frame 120.

The wear insert 140 may be approximately the same or similar shape to that of the surfaces of the opening 122. Thus, the wear insert 140 may be shaped and sized the same and/or similar to the curved surface 126 of the fairlead frame 120. In this way, the wear insert 140 may be coupled to the fairlead frame 120, and may be in face-sharing contact with the curved surface 126 of the frame 120. As such, in the examples shown in FIGS. 2-4, the wear insert 140 may be shaped as a frustum of a cone, with curved sides that may mirror the curved surface 126 of the frame 120. Thus, the insert 140 may define a frustro-conical shape where a front-facing first edge or end 148 may define the cross-sectional area of the opening 122 of the fairlead 10 at the front-facing surface 102 of the frame 120, and a rear-facing second edge or end 150 may define the cross-sectional area of the opening 122 at the rear-facing surface 104 of the frame 120, when the insert 140 is coupled to the frame 120. Similar to the opening 122 described above with reference to FIG. 1, a first perimeter of the first end 148 may be greater than a second perimeter of the second end 150. Thus, the cross-sectional area of the insert 140 may be greater at the first end 148 than the second end 150. However, in other examples, the size and/or shape of the insert 140 may be adjusted to match that of the curved surface 126 of the frame 120.

In this way, the cross-sectional area of the insert 140 may vary from the first end 148 to the second end 150. In particular, the cross-sectional area of the insert 140 may monotonically decrease from the first end 148 to the second end 150, such as is shown in the example of FIGS. 2-4. As such, the insert 140 includes a continuous curved surface 146 that curves outward from the second end 150 to the first end 148. Thus, the continuous curved surface 146 may be the same and/or similar to curved surface 126 of the frame 120. As such, the curved surface 146 may be convex when viewed from the opening 122 looking towards inner wall 152, and may be concave when viewed from the curved surface 126 looking towards outer wall 154.

However, in other examples, the first perimeter of the first end 148 may be the same and/or similar to the second perimeter of the second end 150, and therefore the cross-sectional area of the insert 140 may be approximately the same at the first and second ends 148 and 150. In such examples, the cross-sectional area of the insert 140 may be relatively constant along the thickness or axis X-X' of the frame 120 (e.g., when moving from the front-facing surface 102 to the rear-facing surface 104). However, in still further examples, the first perimeter of the first end 148 may be smaller than the second perimeter of the second end 150, and therefore the cross-sectional area of the insert 140 may be larger at the second end 150 than the first end 148.

The insert 140, and in particular the curved surface 146, includes inner wall 152 and outer wall 154. The outer wall 154 may be positioned opposite the inner wall 152 relative to the central axis X-X', where the central axis X-X' defines a center of the first and second diameters of the wear insert 140 and central opening 122. Thus, the outer wall 154 faces the curved surface 126 of the frame 120, and when coupled to the frame 120, is in face-sharing contact with the curved surface 126 of the frame 120. The inner wall 152 may face inwards, towards the opening 122, away from the curved surface 126 of the frame 120. Thus, the inner wall 152 of the insert 140 may directly physically contact a rope and/or cable that is pulled through the opening 122 of the fairlead 10. In some examples, the rope and/or cable may only physically contact the inner wall 152 of the insert 140 and may not contact the fairlead frame 120. As such, the inner wall 152 may be referred to herein as the contact surface of the fairlead 10. In this way, the insert 140 may be positioned between the frame 120 and the rope and/or cable. Thus, when the insert 140 is coupled to the frame 120, the cross-sectional area of the opening 122 may be defined by the inner wall 152 of the insert 140.

The insert 140 may further include an aperture 144 at the second end 150. Thus, the insert 140 may be open at the first end 148 and second end 150. Additionally or alternatively, the first end 148 may be substantially thick such that it defines a planar edge 156. The planar edge 156 may be disposed around the first perimeter of the first end 148 of the wear insert 140, and may be substantially continuous. Thus, the edge 148 may have substantially the same thickness around the perimeter.

As described above with reference to FIG. 1, the edge 128 of the frame 120 may include a recessed slot 158. The recessed slot 158 may be recessed from the front-facing surface 102 of the frame 120. Thus, the slot 158 may be orthogonal to the plane of the front-facing surface 102. The recessed slot 158 may be sized and/or shaped to receive the planar edge 156 of the first end 148 of the insert 140. As such, the thickness or depth of the slot 158 may be the same and/or similar to that of the planar edge 156. Thus, when coupled to the frame 120, the planar edge 156 of the insert 140 may be in face-sharing contact with the recessed slot 158 of the frame 120. In this way, when the insert 140 is physically coupled to the frame 120, the first end 148 of the insert 140 may be flush with the front-facing surface 102 of the frame 120. Further, the second end 150 of the insert 140 may be flush with the rear-facing surface 104 of the frame 120. In this way, when coupled, the fairlead frame 120 and insert 140 may form a continuous surface. Further, the insert 140 may substantially cover all of the curved surface 126 of the frame 120.

The bores 132 do not include inserts such as insert 140. Thus, only fasteners such as bolts and/or screws may be positioned within the bores 132. As such, the central opening 122 may be the only opening, aperture, and/or orifice of the frame 120 that includes an insert such as insert 140.

Turning to FIG. 5, it shows a front perspective view of the fairlead 10, in which the fairlead 10 is coupled to a winch 502 of a vehicle 504. The vehicle 504 may be one or more of a passenger car, SUV, truck, ATV, sports car, etc. The winch 502 may be coupled to a front of the vehicle 504. However, in other examples, the winch 502 may be coupled to a back of the vehicle 504. The winch 502 includes a motor assembly 506 drivingly connected to a gear reduction unit 508. The motor assembly 506 includes a motor for operating the winch 502. In particular the motor may provide a driving force for retracting a rope and/or cable of the winch 502. The motor may be powered by a battery of the vehicle 502 to which the winch 502 is installed. The motor provides power to the gear reduction unit 508 and the gear reduction unit 508 (e.g., transmission of the winch 502) provides driving torque to a rotatable drum 510.

The gear reduction unit 508 may include a remote controlled clutch inside the end housing. The rotatable drum 510 may a cylinder. A cable 512 (e.g., rope) with a hook 514 at its end may be wound onto, or off from, the rotatable drum 510 to provide various pulling operations. For example, based on the direction of rotation of the drum, the cable 512 may be wound out from (e.g., off the drum) or into (e.g., into the drum) the winch 502. The fairlead 10 guides the cable 512 and acts as a secure stopping point for the hook 514 when being pulled in. In one example, the fairlead 10 may be attached to the front of the winch 502. More specifically, the fairlead 10 may be positioned in front of the drum 510 and may prevent the hook 514 from being pulled all the way inside the winch 502 and onto the drum 510. In another example, the fairlead 10 may be attached to the foremost position of the vehicle 504 (e.g., a vehicle front end), in front of the winch 502 and drum 510. Thus, the opening 122 may be sized to be small enough to prevent the hook 514 from passing through the opening 122.

However, it should be appreciated that in other examples, one or more of the ends 148 and/or 150 of the insert 140 may be raised and/or recessed relative to one or more of the front-facing and rear-facing surfaces 102 and 104, respectively. Further, in some examples, the insert 140 may cover more than, or less than the entire surface area of the curved surface 126 of the frame 120.

Thus, a fairlead may include a wear insert and a composite polymer frame. The wear insert may be constructed from a material that is denser than the fairlead frame. In this way, a technical effect of reducing the weight of the fairlead may be achieved by constructing the fairlead frame from a material of lower density than the wear insert. Another technical effect of reducing degradation to the fairlead frame and/or rope/cable, and reducing frictional losses between the rope/cable and the frame is achieved by including the wear insert with a lower coefficient of static friction.

It will be appreciated that the configurations disclosed herein are exemplary in nature, and that these specific embodiments are not to be considered in a limiting sense, because numerous variations are possible. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A fairlead, comprising:

a frame including a central opening and comprising a first material; and a wear insert positioned within the central opening and comprising a second material, different than the first material, wherein the wear insert includes a planar edge, such that a front of the planar edge is flush with a front-facing surface of the frame, wherein the frame includes a recessed slot for receiving the wear insert, such that the planar edge of the wear insert is substantially flush with the recessed slot of the frame.

2. The fairlead of claim 1, wherein the first material is a polymer material and the second material is one or more of a metal, metal alloy, or metal composite.

3. The fairlead of claim 1, wherein the first material comprises a first density and wherein the second material comprises a second density, where the second density is greater than the first density, such that the wear insert is denser than the frame.

4. The fairlead of claim 1, wherein the central opening extends through an entirety of the frame from the front-facing surface of the frame to a rear-facing surface of the frame, where the front-facing surface and rear-facing surface are arranged in parallel with one another.

5. The fairlead of claim 4, wherein the central opening is defined by a first perimeter at the front-facing surface and a second perimeter at the rear-facing surface, where the first perimeter is larger than the second perimeter and wherein the frame has a continuous curved surface that curves outward from the second perimeter to the first perimeter.

6. The fairlead of claim 5, wherein at the front-facing surface, the central opening is formed by the recessed slot in the frame that extends into the frame from the front-facing surface and wherein the continuous curved surface of the frame is defined between an inner edge of the recessed slot and the rear-facing surface.

7. The fairlead of claim 5, wherein the wear insert has a first end with a third perimeter and a second end with a fourth perimeter, the fourth perimeter smaller than the third perimeter, and wherein the wear insert has a continuous curved surface that extends and curves outward from the fourth perimeter to the third perimeter.

8. The fairlead of claim 7 wherein the continuous curved surface of the wear insert includes an inner wall and outer wall, the outer wall opposite the inner wall relative to a central axis of the fairlead, wherein the outer wall of the wear insert is in face-sharing contact with the continuous curved surface of the frame, and wherein the wear insert is coupled to the continuous curved surface of the frame at the outer wall of the wear insert, where the inner wall of the wear insert forms a contact surface that directly interfaces with a rope or cable.

9. The fairlead of claim 7, wherein the planar edge is disposed around the third perimeter of the first end of the wear insert, where the planar edge is in face-sharing contact with the recessed slot in the frame.

10. The fairlead of claim 4, wherein the central opening has an obround shape with oppositely arranged straight sides connected by curved ends and wherein the curved ends of the central opening have a first diameter at the front-facing surface and a second diameter at the rear-facing surface, where the first diameter is larger than the second diameter.

11. The fairlead of claim 4, further comprising a first mounting aperture and second mounting aperture, each disposed within the front-facing surface of the frame on opposite sides of the central opening.

12. The fairlead of claim 1, wherein the wear insert is stamped or formed from metal and insert molded into the frame.

13. The fairlead of claim 1, wherein the frame is injection molded.

14. A fairlead comprising:

a frame including a central opening extending from a front surface to a rear surface of the frame; and a wear insert coupled to walls of the frame and including a front edge and a back edge, wherein the front edge of the wear insert is flush with the front surface of the frame and the back edge of the wear insert is flush with the rear surface of the frame, wherein the frame includes a recessed slot for receiving the wear insert, such that the front edge of the wear insert is substantially flush with the recessed slot of the frame.

15. The fairlead of claim 14, wherein the walls of the frame form a continuous curved surface between the front surface and the rear surface of the frame.

16. The fairlead of claim 14, wherein the wear insert is positioned between the frame and a rope or cable extending through the central opening.

17. The fairlead of claim 14, wherein the frame comprises a first material and the wear insert comprises a second material, the second material denser than the first material.

18. The fairlead of claim 17, wherein the first material is a polymer material and the second material is one or more of a metal, metal alloy, or metal composite.

19. A fairlead, comprising:

a composite polymer frame including a central opening extending through an entirety of the frame from a front-facing surface to a rear-facing surface of the frame and having a continuous curved surface curving outward from the rear-facing surface to the front-facing surface; and a wear insert coupled to and in face-sharing contact with the continuous curved surface of the composite polymer frame, such that a planar edge of the wear insert is flush with the front-facing surface of the frame, the wear insert comprising a material that is denser than the composite polymer frame, wherein the composite polymer frame includes a recessed slot for receiving the wear insert, such that the planar edge of the wear insert is substantially flush with the recessed slot of the frame.

20. The fairlead of claim 19, wherein the wear insert comprises a metal material.

* * * * *